United States Patent [19]

Pisciotti et al.

[11] Patent Number: 4,883,381

[45] Date of Patent: Nov. 28, 1989

[54] BOOK

[75] Inventors: Trudy Pisciotti, New Milford, N.J.; Dennis Healy, Baltimore, Md.

[73] Assignee: Prentice Hall, Inc., Englewood Cliffs, N.J.

[21] Appl. No.: 241,706

[22] Filed: Sep. 8, 1988

[51] Int. Cl.[4] ..... B42F 1/00

[52] U.S. Cl. ..... 402/74; 402/70; 281/15.1

[58] Field of Search ..... 281/15 A, 16, 33; 402/70, 73, 74

[56] References Cited

U.S. PATENT DOCUMENTS

| | | | |
|---|---|---|---|
| D. 183,711 | 10/1958 | Blaivas . | |
| D. 247,817 | 5/1978 | Hausmann et al. . | |
| D. 271,919 | 12/1983 | Duffy . | |
| D. 278,352 | 4/1985 | Wenstrom et al. . | |
| 700,867 | 5/1902 | Whitlock . | |
| 1,373,136 | 3/1921 | Kranz . | |
| 2,252,783 | 8/1941 | Potts et al. . | |
| 2,333,523 | 11/1943 | Cohun . | |
| 3,091,482 | 5/1968 | Cirigliano . | |
| 3,156,389 | 10/1964 | Walker, Jr. | 281/33 X |
| 3,195,925 | 7/1965 | Walker, Jr. | 281/33 |
| 4,240,761 | 12/1980 | Jacobson . | |
| 4,294,558 | 10/1981 | Errichiello . | |
| 4,616,851 | 10/1986 | Mann . | |

FOREIGN PATENT DOCUMENTS

| | | | |
|---|---|---|---|
| 2364578 | 12/1973 | Fed. Rep. of Germany | 281/15 A |

*Primary Examiner*—Paul A. Bell

*Attorney, Agent, or Firm*—Amster, Rothstein & Ebenstein

[57] ABSTRACT

A book configured for easy carrying comprises a continuous cover and a fastener fixed to the cover for securing paper thereto. The continuous cover includes a spine, front and rear panels, and front and rear flaps, each of the flaps defining an aperture therethrough configured and dimensioned to receive fingers. The flaps are movable between a storage orientation and a carrying orientation, the flaps in the storage orientation being disposed intermediate the panels, overlying the panels, and extending generally towards the spine, and the flaps in the carrying orientation extending generally outwardly from the panels and away from the spine, with both the flap apertures aligned to permit the passage therethrough of fingers and thereby facilitate carrying of the book.

16 Claims, 2 Drawing Sheets

BOOK

BACKGROUND OF THE INVENTION

The present invention relates to books, and more particularly to a book configured for easy carrying.

It has been known to provide a strap adapted to be secured around a book, the strap being provided with a handle for convenience in carrying the book. Similarly, it has been known to provide a carrying case adapted to contain a book, the carrying case having a handle for convenience in carrying the case. However, the foregoing arrangements for carrying books involve an external and separate implement which may become lost or separated from the book and require manipulation by the user for either placing the strap around the book or placing the book in the carrying case; thus, such arrangements are not fully satisfactory.

U.S. Pat. No. 4,616,851 discloses a book in which at least the cover is formed with apertured extensions enabling the book to be grasped by fingers inserted through an aligned pair of the apertures in the extensions, for easy carrying of the book. The extensions are disposed in various embodiments on the top, the bottom or the side opposite the spine of the book. While these extensions enable carrying of the book without the need for resort to an adjunct such as a strap or carrying case, the extensions themselves present problems. The extensions increase at least one dimension of the book (that is, its height or width) by a substantial fraction, as they must in order to enable apertures large enough for easy insertion of the fingers. This not only makes the books somewhat more difficult to handle during reading, but, more importantly, necessitates specialized—i.e., enlarge—library shelving for the book.

Accordingly, it is an object of the present invention to provide a book with a construction which facilitates its easy carrying.

Another object is to provide such a book which facilitates its easy carrying without employment of an external and separable implement.

A further object is to provide such a book which does not have an enlarged dimension during reading or storage simply to facilitate carriage of the book.

SUMMARY OF THE INVENTION

It has now been found that the above and related objects of the present invention are obtained in a book configured for easy carrying comprising a continuous cover and means fixed to the cover for securing paper thereto The continuous cover includes a spine, front and rear panels, and front and rear flaps, each of the flaps defining an aperture therethrough configured and dimensioned to receive fingers. The front and rear panels are connected to the spine along one panel edge by first foldlines and to the flaps along the remote panel edge by second foldlines. The flaps are movable between a storage orientation and a carrying orientation. The flaps in the storage orientation are disposed intermediate the panels, overlying the panels, and extending generally towards the spine. The flaps in the carrying orientation extend generally outwardly from the panels and away from the spine, with both the flap apertures aligned to permit the passage therethrough of fingers and thereby facilitate carrying of the book.

Preferably, the flaps taper inwardly away from the second foldlines. In the storage orientation the flaps do not appreciably add to the peripheral dimensions of the cover, and in the carrying orientation they are substantially flush together outwardly of the flap apertures or convergent. The flap apertures are elongated slots extending parallel to the spine.

The cover defines an open-sided carrying case for paper when the flaps are in the carrying orientation with the spine serving as the bottom thereof, the flaps as the top thereof, and the panels as the front and rear thereof.

In a preferred embodiment, the book may be a looseleaf notebook having a continuous cover formed of plastic with parallel foldlines. The spine, the panels and the flaps are substantially sheet members, and the spine and the panels are substantially stiff. The panels are movable between a closed orientation wherein they are generally parallel and an open orientation wherein they are at least transverse.

The invention also encompasses a book comprising a continuous cover including spine, front and rear panels connected at one end thereof to opposite sides of the spine by first foldlines, and apertured front and rear flaps connected to the opposite ends of the panels by second foldlines and movable about the second foldlines between a folded back storage orientation and an extended carrying orientation wherein the flap apertures are aligned to receive fingers therethrough.

BRIEF DESCRIPTION OF THE DRAWING

The above brief description, as well as further object and features of the present invention, will be more fully understood by references to the following detailed description of the presently preferred, albeit illustrative, embodiments of the present invention when taken in conjunction with the accompanying drawing wherein.

DETAILED DESCRIPTION OF THE PREFERRED EMBODIMENTS

Figures 1, 4:
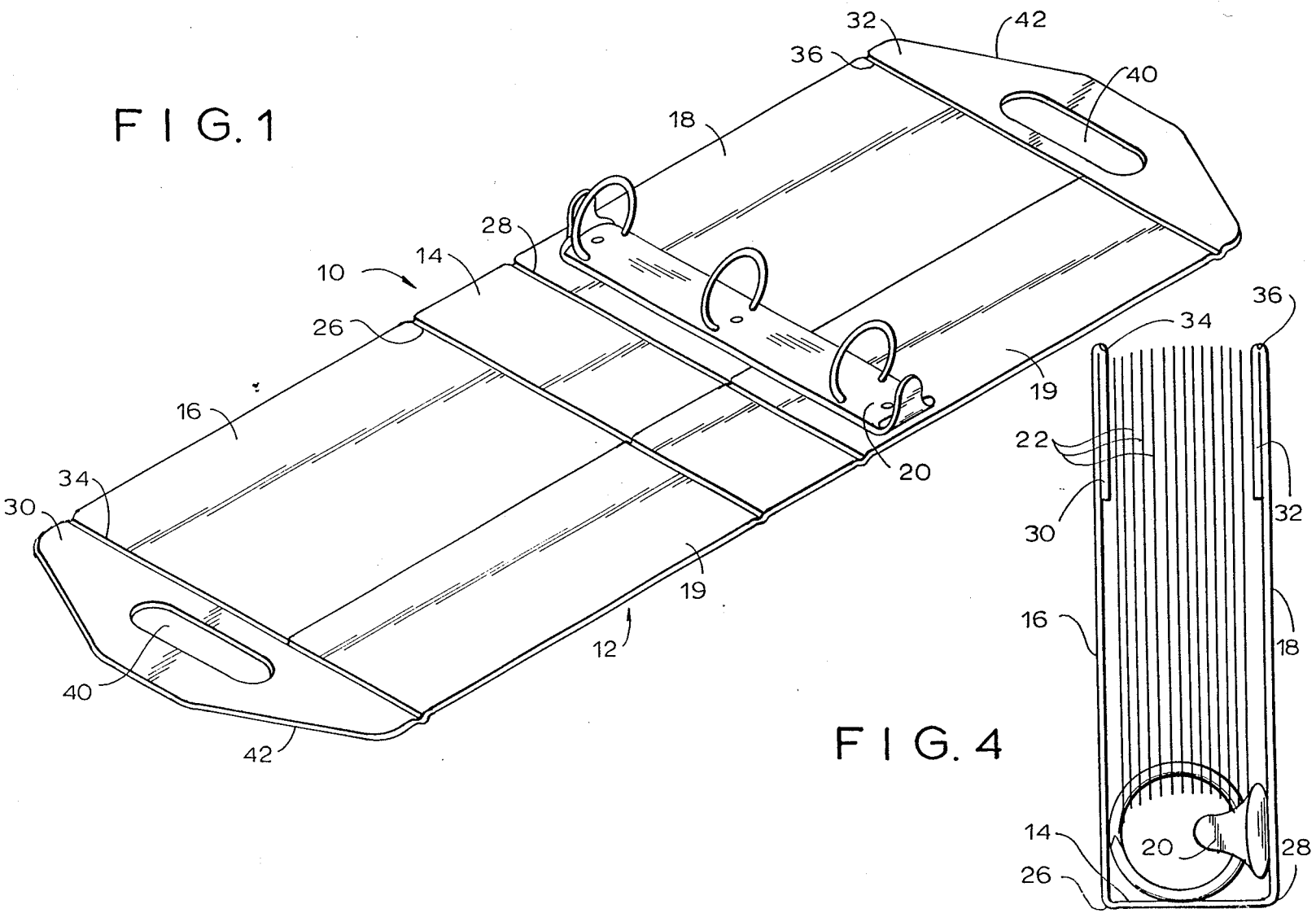
FIG. 1 is an isometric view of an open book according to the present invention, with the flaps in the carrying position.
FIG. 4 is an end elevation view of a closed book with papers therein, with the flaps being shown in the storage orientation.

Referring now to the drawing and in particular to FIG. 1 thereof, therein illustrated is an open book according to the present invention, generally designated by the reference numeral 10. In its conventional aspects the book 10 includes a continuous cover generally designated 12 including a spine or backing 14 and front and rear panels 16 and 18 connected at one side edge to the spine 14. The spine 14 and panels 16, 18 are preferably, although not necessarily, substantially stiff. If desired, the inner surfaces of the panels 16, 18 may contain pockets 19 for carrying pencils, keys and the like. Secured to the spine 14 or to one of the panels 16, 18 are means 20 for maintaining between the panels 16, 18 a plurality of leaves or pages 22 (see FIG. 3). The maintaining means 20 may constitute conventional bindings, fasteners, looseleaf rings (as illustrated), etc.

The front and rear panels 16, 18 are connected to the spine 14 along one panel side edge by first foldlines 26, 28, respectively. The foldlines 26, 28 constitute a weakened or relatively flexible linear zone which extends along the length of the spine 14 and permits pivotal or hinged movement of each panel 16, 18 about the spine 14 within a limited range of motion—here, the normal movement of the cover panels 16, 18 relative to the spine 14 to open and close the book.

Figure 3:
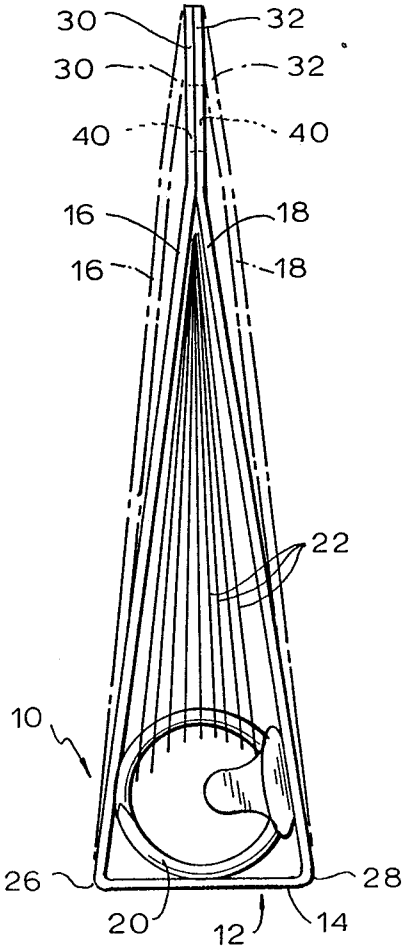
FIG. 3 is an end elevation view of a closed book with papers therein, the flaps being shown in two different carrying orientations, one in solid line and one in phantom line.
Figure 2:
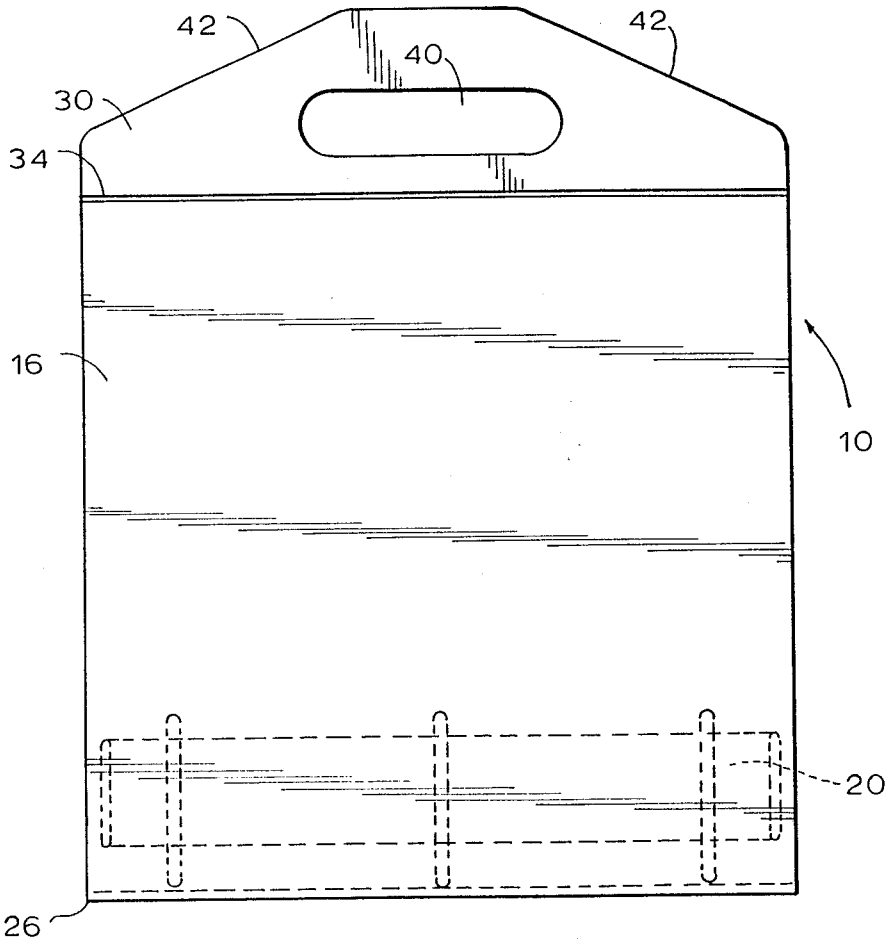
FIG. 2 is a front elevation view of a closed book with the flaps in the carrying orientation.

In its novel aspects, the book 10 includes front and rear flaps 30, 32. Along the remote panel side edges, the front and rear panels 16, 18 are connected to the front and rear flaps 30, 32, by second foldlines 34, 36, respectively. Each flap 30, 32 is hinged or pivotable, about the second foldline 34, 36 connecting it to the panel 16, 18, between a storage orientation and a carrying orientation. In the storage orientation, as illustrated in FIG. 4, the flaps 30, 32 are disposed intermediate the panels 16, 18 (when the book is closed), overlie the panels 16, 18, and extend generally toward the spine 14. In the carrying orientation, as illustrated in FIGS. 2 and 3, the flaps 30, 32 extend generally outwardly from the panels 16, 18 and away from the spine 14. Thus when the book is closed (see FIGS. 2 and 3) and being stored—and in all likelihood when the book is open (see FIG. 1) and being read—the front and rear flaps 30, 32 are folded out of the way, as illustrated in FIG. 4, typically between the front panel 16 and the first leaf 22 and between the rear leaf 22 and the rear panel 18, respectively. In this orientation the flaps 30, 32 do not appreciably affect the height or width of the book and are indeed almost invisible to the casual spectator. The material of the second foldlines 34, 36 is either non-resilient or only minimally resilient so that the flaps 30, 32 tend to remain in their initial orientation.

As illustrated in FIG. 1, it is possible for the book 10 to be open, with the front and rear panels 16 and 18 extended, while simultaneously the flaps 30, 32 are in the carrying orientation. This is not a generally recommended configuration, however, as the extended flaps 30, 32 make the book more difficult to handle and manipulate during reading.

Each of the flaps 30, 32 defines an aperture or slot 40 therethrough configured and dimensioned to receive the fingers of the carrier. The apertures 40 extend generally parallel to the foldlines 26, 28, 34, 36. When the book is closed and the flaps 30, 32 are in the carrying orientation, as illustrated in FIGS. 2 and 3, the flap apertures 40 are aligned to permit the passages therethrough of the fingers and thereby facilitate carrying of the book. When there are not many leaves 22 in the book 10, the flaps 30, 32, and especially the portions of the flaps 30, 32 extending outwardly of the flap apertures 40, are substantially flush when the flaps 30, 32 are in the carrying orientation, as illustrated in solid line in FIG. 3. On the other hand, when there are many leaves 22 in the book so as to maintain a spacing between the free ends of the panels 16, 18, the flaps 30, 32 assume a more convergent configuration in the carrying orientation, as illustrated in phantom line in FIG. 3.

If desired, the facing surfaces of the flaps 30, 32 in the carrying orientation may be provided with fastening means, such as mating Velcro surfaces, to facilitate in maintaining the flaps together even when the book is laid down and the fingers removed from the flap apertures 40. Preferably the flaps 30, 32 taper inwardly from the panels 16, 18, as shown at 42, although other configurations may be used. The flaps 30, 32 may be substantially stiff; however, a certain degree of give and flexibility is preferred so that the flaps 30, 32 do not injure the hand of the carrier.

The entire continuous cover 12 is preferably formed of a plastic having sufficient strength to enable the weight of the book to be borne by the flaps 30, 32, while still enabling the formation of foldlines which permit the relatively free movement of the flaps 30, 32 relative to the panels 16, 18 and the panels 16, 18 relative to the spine 14, all within limited ranges of motion.

It will be appreciated that while the principles of the present invention have been illustrated in connection with a looseleaf notebook, a standard perfect-bound or other book may be employed. The present invention finds particular utility in connection with large or heavy books which are normally difficult to carry, such as a dictionary, bulky training manuals, computer printouts and the like.

It will also be appreciated that when the book 10 is closed and the flaps 30, 32 are in the carrying orientation, the cover 12 defines an open-sided carrying case for paper 22 with the spine 14 serving as the bottom, the flaps 30, 32 as the top and the panels 16, 18 as the front and rear.

To summarize, the book according to the present invention has a unique construction which facilitates its being carried without the employment of an external separable implement and yet does not require the presence of an enlarged dimension during reading or storage simply to facilitate carriage of the book at another time.

Now that the preferred embodiments of the present invention have been shown and described in detail, various modifications and improvements thereon will become readily apparent to those skilled in the art. Accordingly, the appended claims should be construed broadly and in a manner consistent with the spirit and scope of the invention herein.

We claim:

1. A book configured for easy carrying, comprising:
(a) a continuous cover including:
i. a spine;
ii. front and rear panels;
iii. front and rear flaps, each of said flaps defining an aperture therethrough configured and dimensioned to receive fingers;
said front and rear panels being connected to said spine along one panel edge by first foldlines and to said flaps along said remote panel edge by second foldlines;
said flaps being movable between a storage orientation and a carrying orientation, said flaps in said storage orientation being disposed intermediate said panels, and extending generally towards said spine, said flaps in said carrying orientation extending generally outwardly from said panels and away from said spine, with both said flap apertures aligned to permit passage therethrough of fingers and thereby facilitate carrying of said book; and
(b) means fixed to said cover for securing paper thereto, said securing means being located adjacent the connection of said spine and one of said panels so as to avoid said securing means or the paper precluding movement of either of said flaps to said storage orientation.

2. The book of claim 1 wherein said foldlines are parallel.

3. The book of claim 1 wherein said cover is formed of plastic.

4. The book of claim 1 wherein said flaps taper inwardly away from said second foldlines.

5. The book of claim 1 wherein said book is a loose-leaf notebook.

6. The book of claim 1 wherein said flaps in said storage orientation do not appreciably add to the peripheral dimensions of said cover.

7. The book of claim 1 wherein said spine and said panels are substantially stiff.

8. The book of claim 1 wherein said flaps in said carrying orientation are substantially flush together outwardly of said flap apertures.

9. The book of claim 1 wherein said flaps in said carrying orientation are convergent.

10. The book of claim 1 wherein said cover defines an open-sided carrying case for paper when said flaps are in said carrying orientation with said spine serving as said bottom thereof, said flaps as said top thereof, and said panels as said front and rear thereof.

11. The book of claim 1 wherein said flap apertures are elongated slots extending parallel to said spine.

12. The book of claim 1 wherein said spine, said panels and said flaps are substantially sheet members.

13. The book of claim 1 wherein said panels are movable between a closed orientation wherein said panels are generally parallel and an open orientation wherein said panels are at least transverse.

14. The book of claim 1 wherein said flaps in said storage orientation extend substantially parallel to said panels.

15. A book configured for easy carrying, comprising:

a. a continuous cover of plastic including:

i. a spine;

ii. front and rear panels iii. front and rear flaps, each of said flaps defining an aperture therethrough in the form of an elongated slot extending parallel to said spine configured and dimensioned to receive fingers;

said front and rear panels being connected to said spine along one panel edge by first foldlines and to said flaps along said remote panel edge by second foldlines, said first and second foldlines being parallel;

said panels being movable between a closed orientation wherein said panels are generally parallel and an open orientation wherein said panels are at least transverse;

said flaps tapering inwardly away from said second foldlines and being movable between a storage orientation and a carrying orientation, said flaps in said storage orientation being disposed intermediate said panels, overlying said panels without appreciably adding to the peripheral dimensions thereof, and extending substantially parallel to said panels generally towards said spine, said flaps in said carrying orientation extending generally outwardly from said panels and away from said spine, with both said flap apertures aligned to permit passage therethrough of fingers and thereby facilitate carrying of said book, said spine, said panels and said flaps being substantially sheet members; and b. means fixed to said cover for securing paper intermediate said panels, said securing means being located adjacent the connection of said spine and one of said panels so as to avoid said securing means or the paper precluding movement of either of said flaps to said storage orientation.

16. The book of claim 15 wherein said cover defines an open-sided carrying case for paper when said flaps are in said carrying orientation with said spine serving as said bottom thereof, said flaps as said top thereof, and said panels as said front and rear thereof.

* * * * *